US010959495B2

(12) United States Patent
MacArthur

(10) Patent No.: US 10,959,495 B2
(45) Date of Patent: Mar. 30, 2021

(54) SECURE ZIPPER FOR USE WITH ENCLOSURE

(71) Applicant: Erin MacArthur, Millinocket, ME (US)

(72) Inventor: Erin MacArthur, Millinocket, ME (US)

( * ) Notice: Subject to any disclaimer, the term of this patent is extended or adjusted under 35 U.S.C. 154(b) by 0 days.

(21) Appl. No.: 16/524,328

(22) Filed: Jul. 29, 2019

(65) Prior Publication Data

US 2021/0030121 A1 Feb. 4, 2021

(51) Int. Cl.
*A44B 19/30* (2006.01)
*E05B 65/44* (2006.01)

(52) U.S. Cl.
CPC ..... *A44B 19/301* (2013.01); *E05B 65/44* (2013.01)

(58) Field of Classification Search
CPC ... E05B 65/44; A44B 19/301; Y10T 24/2511; A61G 7/0526
See application file for complete search history.

(56) References Cited

U.S. PATENT DOCUMENTS 6,487,735 B1 * 12/2002 Jacques, II ..... A47D 7/02 5/424
7,971,596 B2 * 7/2011 Morris ..... A47C 29/003 135/96
8,938,824 B2 * 1/2015 Rensink ..... A47C 31/105 5/499
9,545,158 B2 * 1/2017 Goldberg ..... A47C 31/007
9,888,747 B2 * 2/2018 Smith ..... A44B 19/30
9,986,846 B1 * 6/2018 Davis ..... A47C 31/105

* cited by examiner

*Primary Examiner* — Robert Sandy
*Assistant Examiner* — Louis A Mercado
(74) *Attorney, Agent, or Firm* — Anthony D. Pellegrini

(57) ABSTRACT

A secure zipper that can be used for enclosures that prevents manipulation of the zipper pulls when the enclosure is in a closed state, other than by use of the pull tabs of the zipper pulls, by use of a security barrier placed along side the zipper proximate to the end of the zipper.

16 Claims, 10 Drawing Sheets

SECURE ZIPPER FOR USE WITH ENCLOSURE

BACKGROUND OF THE INVENTION

Zippers are well known in the art. A zipper is a device for bringing and retaining two surfaces together. This is achieved by attaching a set of zipper teeth to each of the surfaces, and then engaging or disengaging the zipper teeth to or from each other by means of a zipper pull. The zipper pull comprises a zipper teeth engagement component and a pull tab attached thereto. When the zipper teeth engagement component is moved along the zipper teeth in one direction, the zipper teeth are interlocked with each other, creating a secure bond, and when the zipper teeth engagement component is moved along the sets of zipper teeth in the opposite direction, the zipper teeth are disengaged from each other. The pull tab of the zipper pull allows the user to more easily move the zipper teeth engagement component in either direction.

Zippers may also comprise a pair of zipper pulls, where the movement of each zipper pull along the zipper teeth results in an opposite engagement/disengagement action from the other. Thus, if a lower zipper pull is moved in a downward direction to disengage the zipper teeth above it, an upper zipper pull moved in the same direction will re-engage those same zipper teeth. This is commonly known in the prior art.

Zippers are used to close and open myriad items. In a common application, zippers may be used to secure entryways to enclosures. That is, an enclosure may have an entryway that is coverable by a door; the door may be secured by a zipper such that passage through the entryway is prevented, and the door may be released by a zipper such that passage through the entryway may be achieved.

In one example, the enclosure may be a bed enclosure. Bed enclosures are typically comprised of barriers erected along the perimeter of a bed, with one or more closeable entryways formed into the barriers to allow entry into the interior of the enclosure. Bed enclosures are typically intended for use with persons who are prone to falling out of bed or who otherwise may need to be restrained in bed. Such bed enclosures are typically used in health care settings for persons with physical or mental disabilities. They are an improvement over bodily restraints that might otherwise be used to prevent injury. In some cases, the door closing the entryway of the bed enclosure is fastened by use of a zipper, and typically a zipper having a pair of zipper pulls. The pull tabs of the zipper pulls are situated on the exterior of the bed enclosure, in order to prevent a person within the bed enclosure from accessing the pull tabs. However, it has been shown that a person within the bed enclosure can manipulate the zipper pulls even without having access to the pull tabs, by manipulated the zipper teeth engagement components from behind. This diminishes the effectiveness of the bed enclosure in achieving its purpose of restraining the user.

In another example, the enclosure may be a tent. Tents typically have a closeable entryway formed into one of the tent flaps to allow entry into the interior of the tent. Tents typically secure a door covering the entryway by use of a zipper, and typically a zipper having a pair of zipper pulls. The pull tabs of the zipper pulls are situated on the interior of the tent, in order to prevent a person outside of the tent from accessing the pull tabs. However, as described above, a person outside of the tent can manipulate the zipper pulls even without having access to the pull tabs. This diminishes the security of the persons within the tent.

From the above examples, it is shown that there is a need for a secure zipper that can be used for enclosures and that prevents manipulation of the zipper pulls other than by the pull tabs of the zipper pulls.

The present invention therefore discloses a secure zipper that can be used for enclosures and that prevents manipulation of the zipper pulls other than by the pull tabs of the zipper pulls.

SUMMARY OF THE INVENTION

The present invention discloses a secure zipper that can be used for enclosures and that prevent manipulation of the zipper pulls when the enclosure is in a closed state, other than by use of the pull tabs of the zipper pulls. This is achieved by affixing a security barrier to the zipper along side the zipper teeth sets proximate to the end of the zipper teeth sets. The security barrier is dimensioned large enough such that neither the pull tabs of the zipper pulls nor the zipper teeth engagement components of the zipper pulls can be manipulated from the same side of the zipper as the security barrier once the zipper pulls are positioned behind the security barrier.

DETAILED DESCRIPTION OF THE INVENTION

Figure 3:
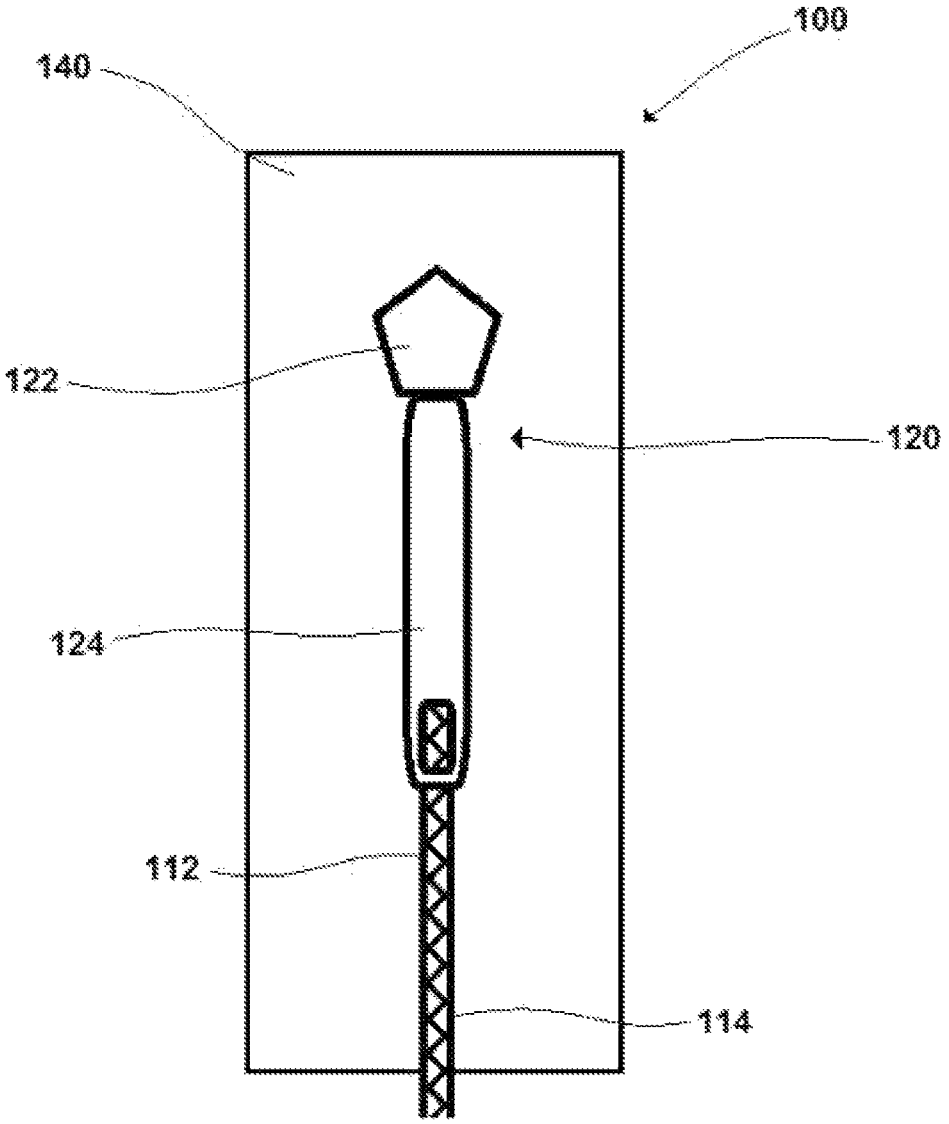
FIG. 3 is a front plan view of the secure zipper of the present invention, having a single zipper pull.

In one embodiment of the present invention, the secure zipper 100 to be used in conjunction with an enclosure 20 having an entryway 26. The secure zipper 100 serves to close a door 28 to the entryway 26 to the enclosure 20. The secure zipper 100 comprises a first set of zipper teeth 112, a second set of zipper teeth 114, a first zipper pull 120, and a security barrier 140. The first set of zipper teeth 112 are located along the edge of the enclosure 20 defining the entryway 26. The second set of zipper teeth 114 are located along the edge of the door 28 proximate to the edge of the enclosure 20 defining the entryway 26. The security barrier 140 is fixedly attached to the edge of the enclosure 20 and the edge of the door 28, proximate to the terminal end of the secure zipper 100. The first zipper pull 120 is located adjacent to the first set of zipper teeth 112 and the second set of zipper teeth 114 and in engagement therewith. See FIG. 3.

Figure 1A:
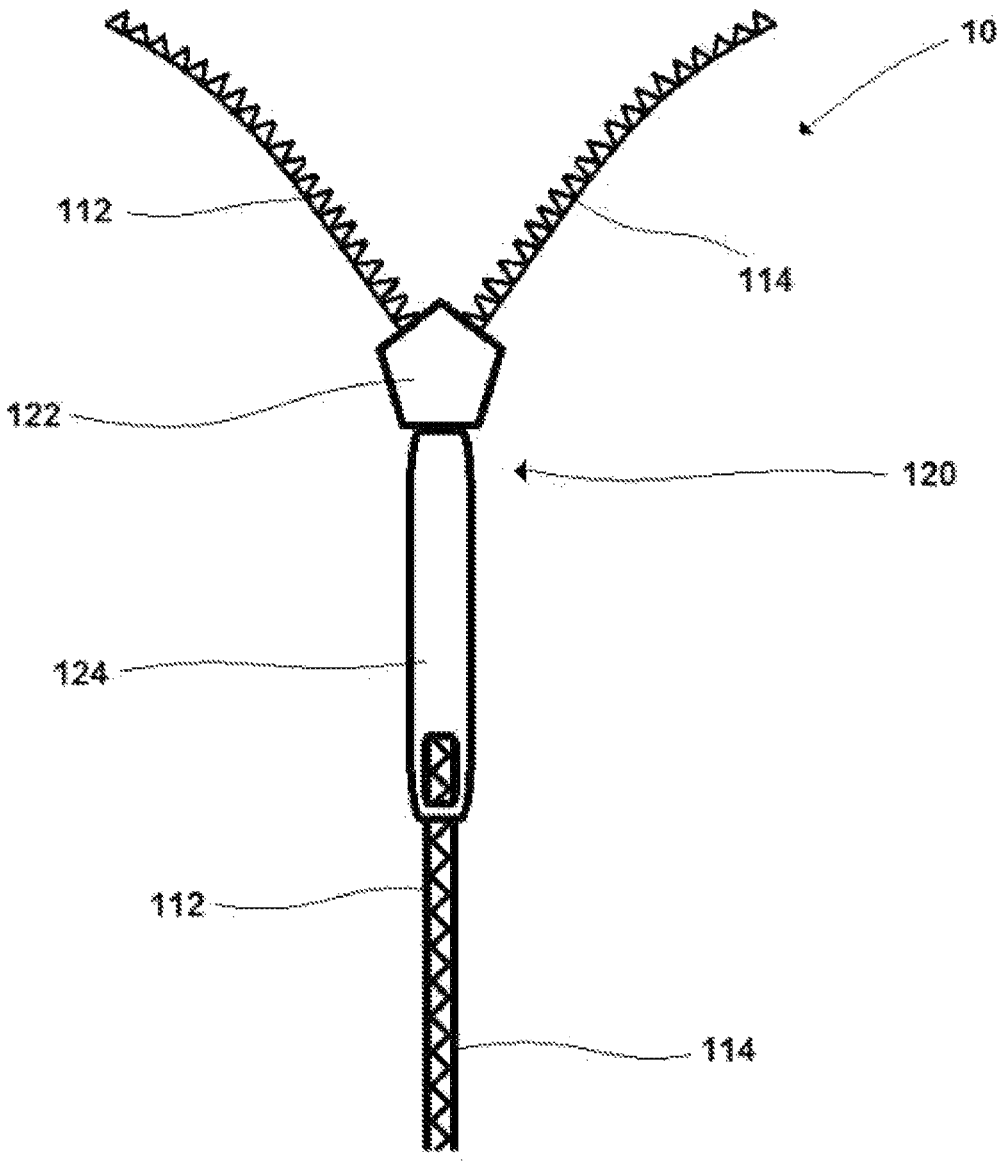
Fig. 1A (PRIOR ART)
FIG. 1A is a front plan view of a zipper having a single zipper pull, partially unzipped, as is known in the prior art.

The first zipper pull 120 has a zipper teeth engagement component 122 and a pull tab 124 attached thereto. The zipper teeth engagement component 122 of the first zipper pull 120 engages with the first set of zipper teeth 112 and with the second set of zipper teeth 114. Movement of the zipper teeth engagement component 122 of the first zipper pull 120 in a first direction causes the first set of zipper teeth 112 to engage with the second set of zipper teeth 114 in an interlocking manner. Movement of the zipper teeth engagement component 122 of the first zipper pull 120 in a second direction opposite the first direction causes the first set of zipper teeth 112 to disengage from the second set of zipper teeth 114. This is operation is well-known in the art, and is seen with ordinary zippers 10. See FIG. 1A.

Figure 2:
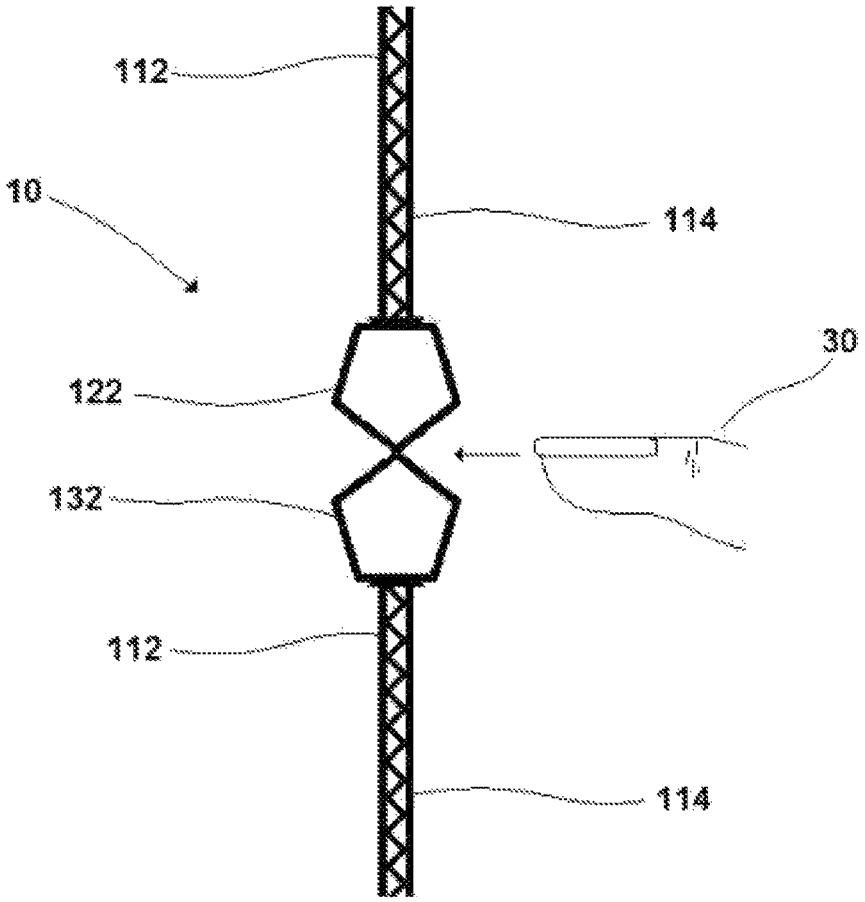
Fig. 2 (PRIOR ART)
FIG. 2 is a rear plan view of a zipper having a pair of zipper pulls, as is known in the prior art, illustrating how the insertion of a finger in between the zipper pulls can allow for the zipper to become unzipped.
Figure 5:
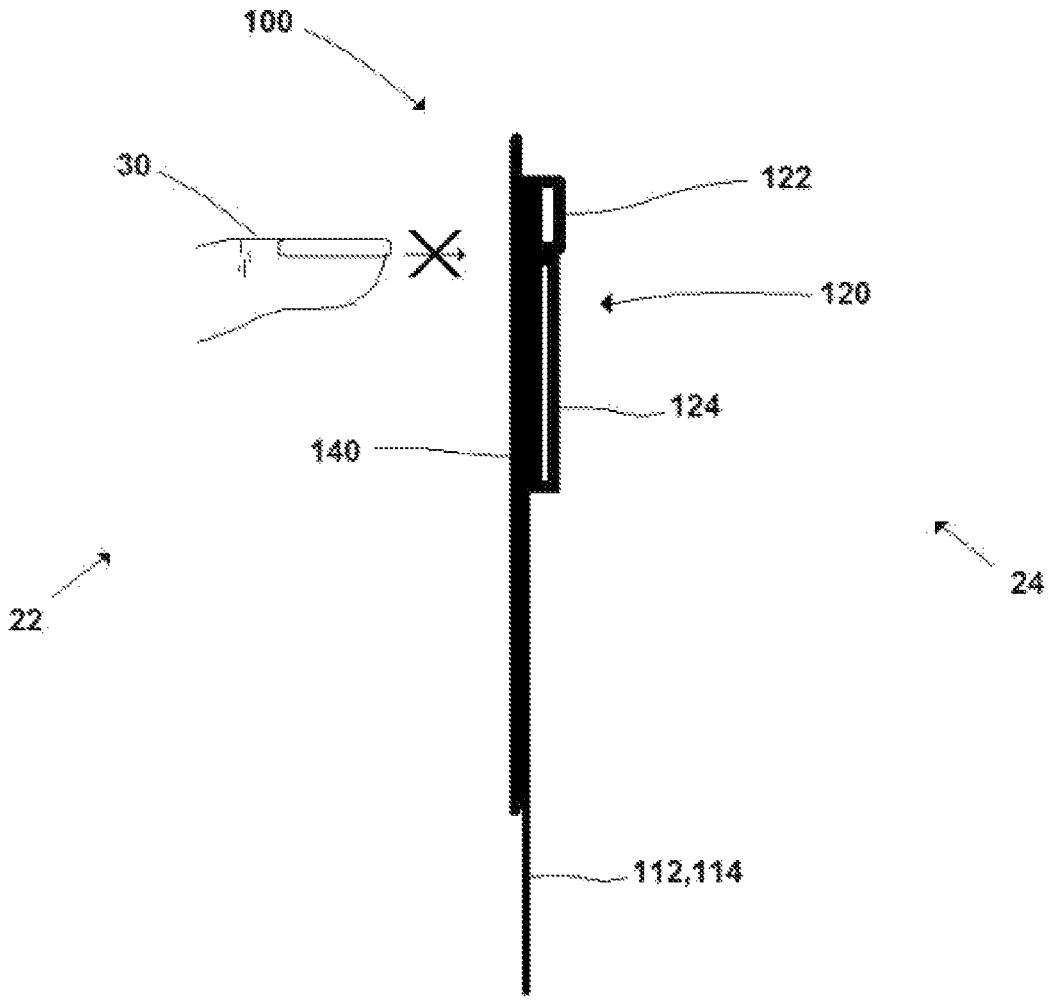
FIG. 5 is a side plan view of the secure zipper of the present invention, having a single zipper pull, illustrating how a finger is prevented by the security barrier from being able to manipulate the zipper pull, thereby preventing the zipper from becoming unzipped.
Figure 6:
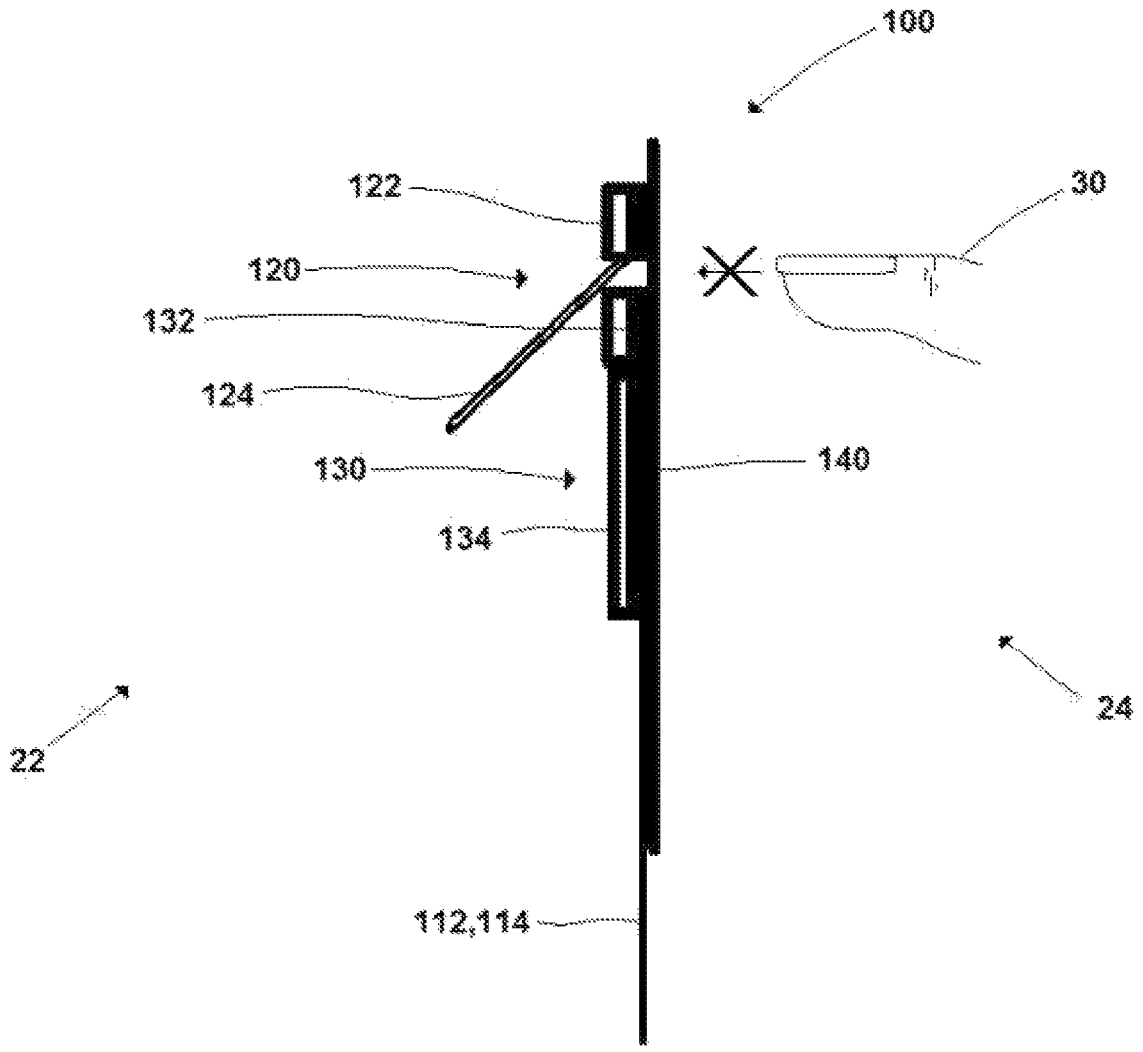
FIG. 6 is a side plan view of the secure zipper of the present invention, having a pair of zipper pulls, illustrating how a finger is prevented by the security barrier from being inserted in between the zipper pulls, thereby preventing the zipper from becoming unzipped.
Figure 7A:
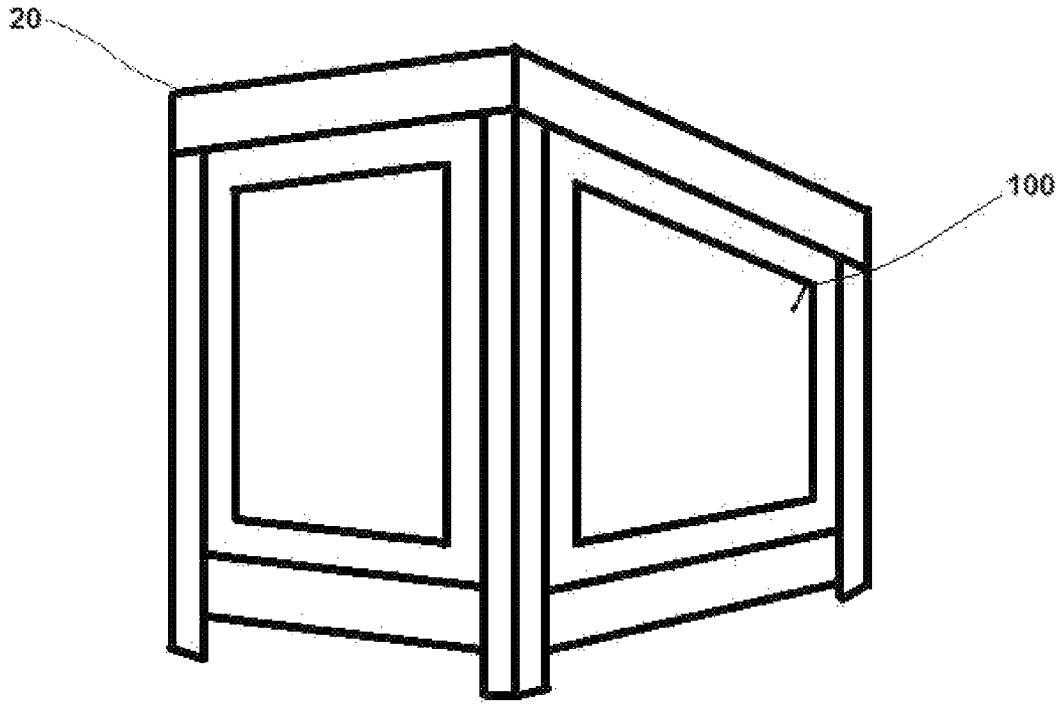
FIG. 7A is a perspective view of an enclosure having its entryway covered by a door secured by the secure zipper of the present invention.
Figure 7B:
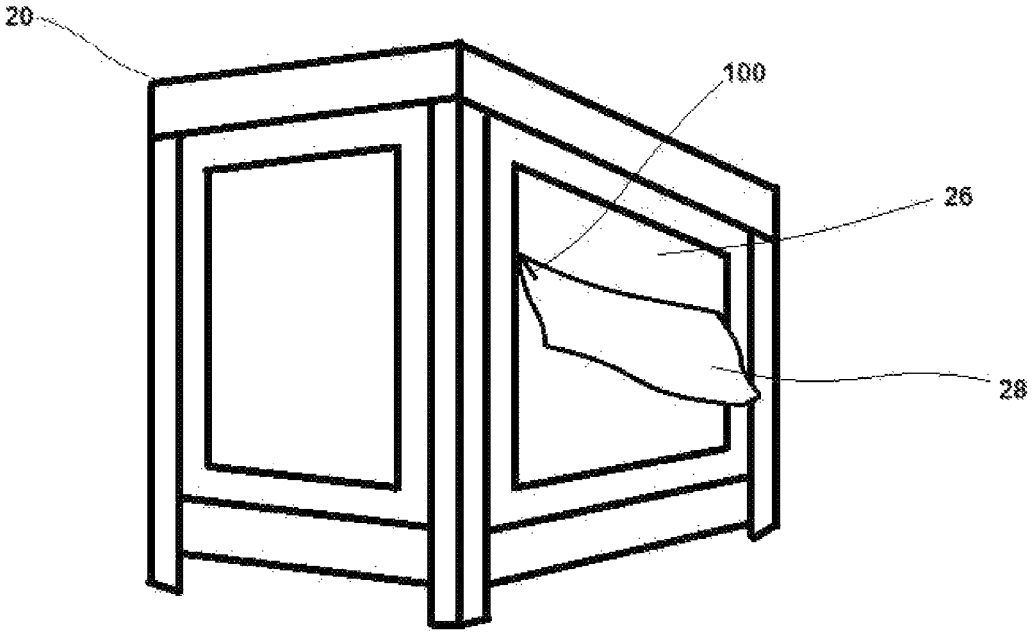
FIG. 7B is a perspective view of the enclosure of FIG. 7A having its entryway uncovered.
Figure 8A:
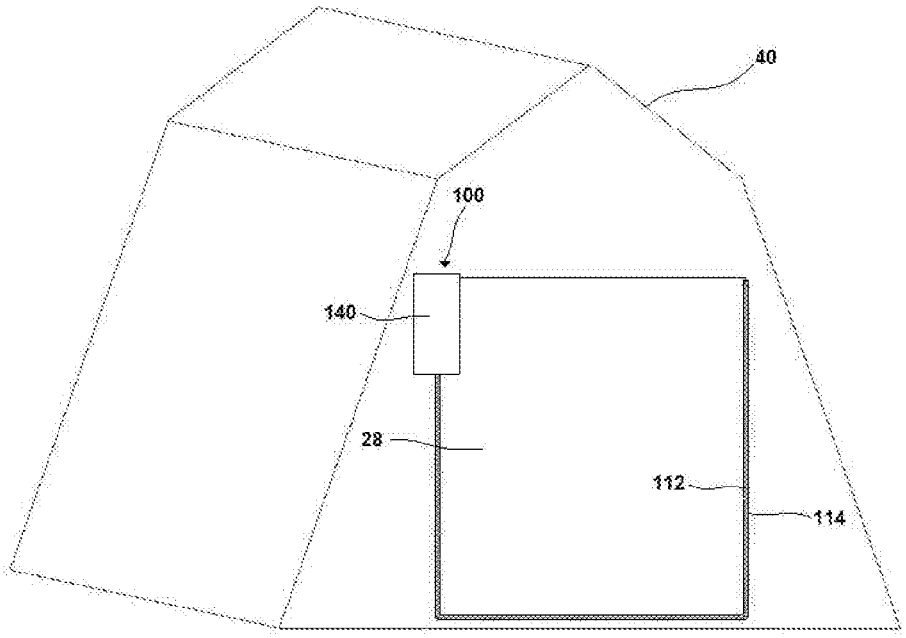
FIG. 8A is a perspective view of the secure zipper of the present invention mounted on a tent, as seen from the exterior of the tent.
Figure 8B:
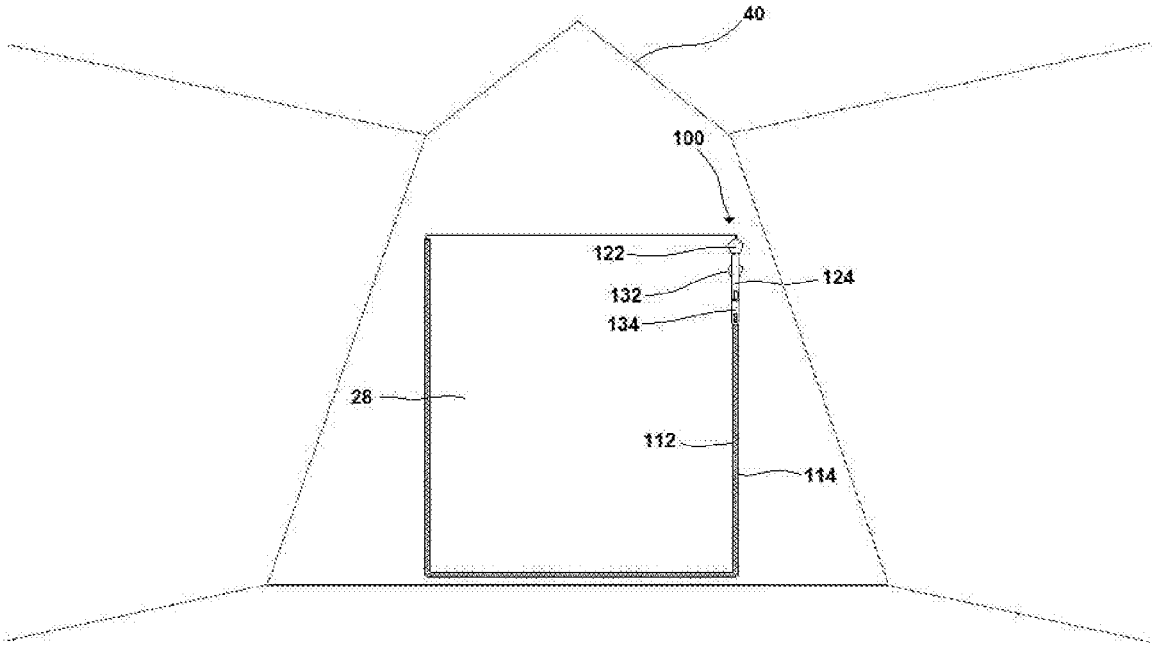
FIG. 8B is a plan view of the secure zipper of the present invention shown in FIG. 8A, as seen from the inside of the tent.

The security barrier 140 has a width and a length. The length of the security barrier 140 is greater than the length of the pull tab 124 of the first zipper pull 120. The width of the security barrier 140 is wider than the width of the first zipper pull 120. When the first zipper pull 120 is positioned at the terminal end of the secure zipper 100, the entirety of the zipper teeth engagement component 122 and the pull tab 124 of the first zipper pull 120 is located behind the security barrier 140. This prevents anyone from manipulating the first zipper pull 120 from the back side of the secure zipper 100, see FIGS. 5 and 6, for example, by placing a finger 30 on the first zipper teeth engagement component 122 of the first zipper pull 120 and moving it in either the first direction or the second direction, as is possible when using ordinary zippers 10. See FIG. 2. The security barrier 140 may be of any suitable shape. In the preferred embodiment, it is substantially rectangular. The security barrier 140 may be made of any suitable material. In the preferred embodiment, it is made of canvas.

Figure 1B:
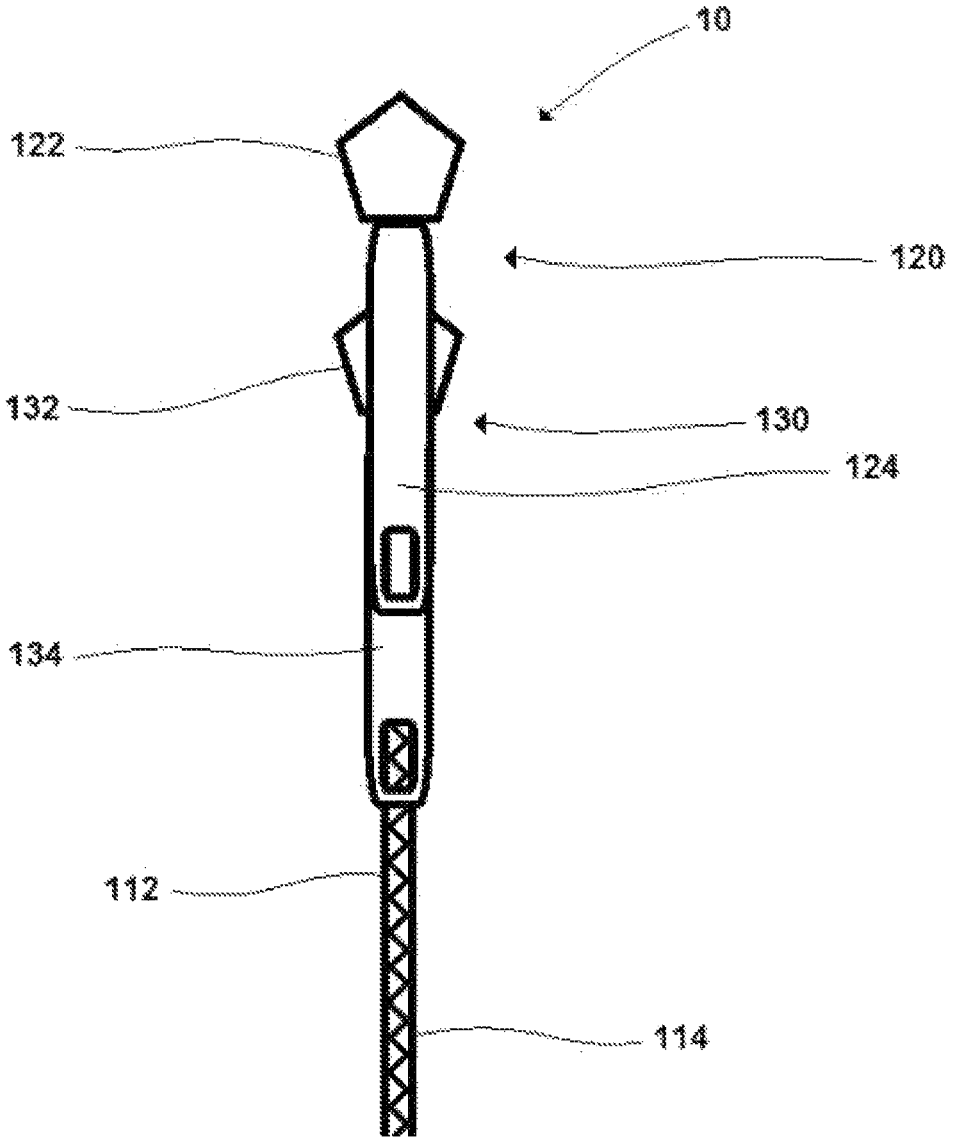
Fig. 1B (PRIOR ART)
FIG. 1B is a front plan view of a zipper having a pair of zipper pulls, fully zipped, as is known in the prior art.
Figure 4:
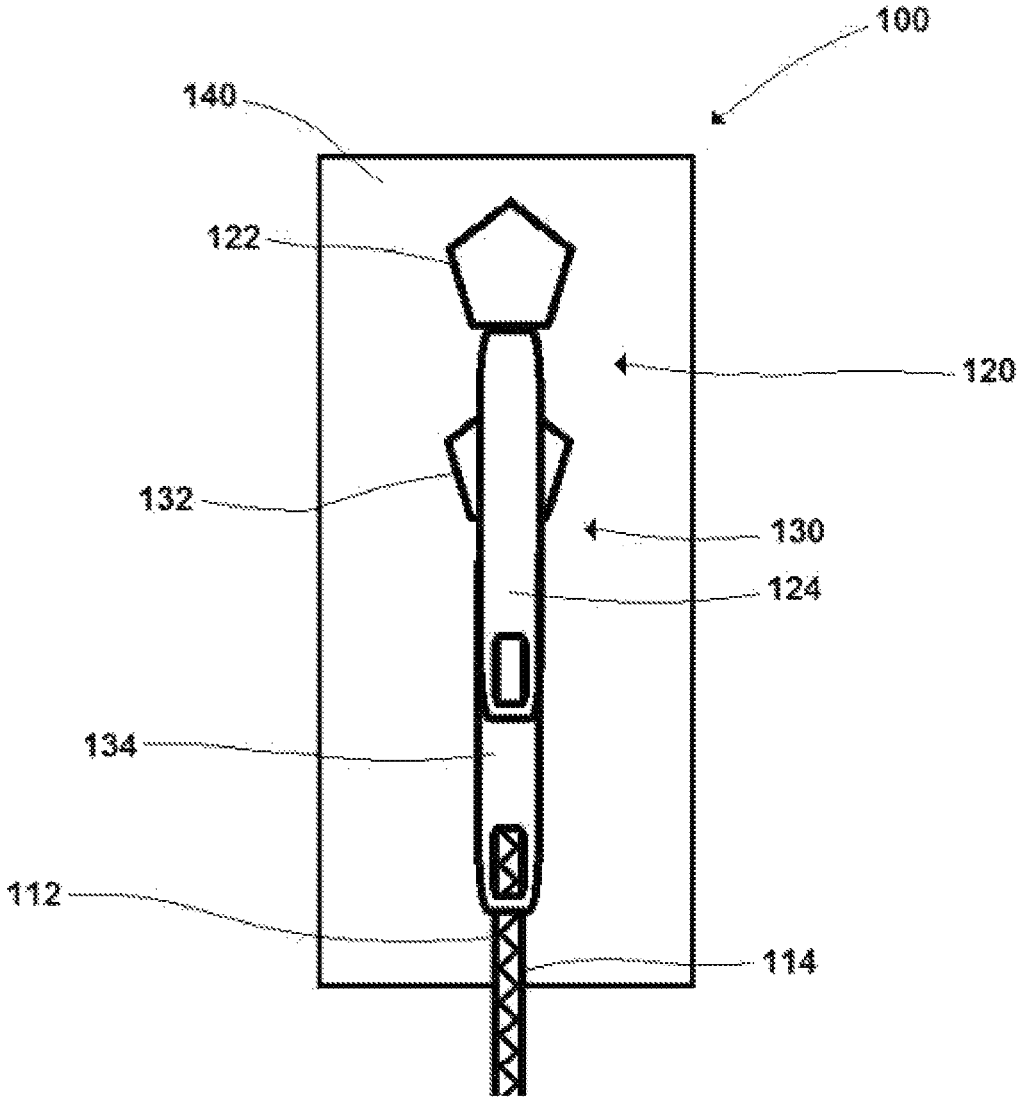
FIG. 4 is a front plan view of the secure zipper of the present invention, having a pair of zipper pulls.

In an alternate embodiment, the secure zipper 100 has a second zipper pull 130 in addition to the first zipper pull 120. The second zipper pull 130 has a zipper teeth engagement component 132 and a pull tab 134 attached thereto. The zipper teeth engagement component 132 of the second zipper pull 130 engages with the first set of zipper teeth 112 and with the second set of zipper teeth 114. The second zipper pull 130 is located adjacent to the first set of zipper teeth 112 and the second set of zipper teeth 114 and in engagement therewith. The length of the security barrier 140 in this embodiment is greater than the length of the pull tab 124 of the first zipper pull 120 plus the length of the pull tab 134 of the second zipper pull 130. See FIG. 4. Movement of the zipper teeth engagement component 132 of the second zipper pull 130 in the second direction causes the first set of zipper teeth 112 to engage with the second set of zipper teeth 114 in an interlocking manner. Movement of the zipper teeth engagement component 132 of the second zipper pull 130 in the first direction opposite the second direction causes the first set of zipper teeth 112 to disengage from the second set of zipper teeth 114. This is operation is well-known in the art, and is seen with ordinary zippers 10. See FIG. 1B.

In one embodiment, the secure zipper 100 of the present invention is located on the interior side 22 of the enclosure 20 and the pull tab 124 of the first zipper pull 120 is located on an exterior side 24 of the enclosure 20. See FIG. 5. When a second zipper pull 130 is used, it is positioned in the same way relative to the security barrier 140 as the first zipper pull 120. In this embodiment, a person located exterior 24 to the enclosure 20 can use the secure zipper 100 to close the door 28 of the enclosure 20 and position the pull tab 124 of the first zipper pull 120 (and the pull tab 134 of the second zipper pull 130, if used) behind the security barrier 140. This prevents access to the pull tab 124 of the first zipper pull 120 (and the pull tab 134 of the second zipper pull 130, if used) to persons located within the interior 22 of the enclosure 20. This configuration is useful when the goal is to keep persons within the enclosure 20, such as when the enclosure 20 is a bed enclosure.

In another embodiment, the secure zipper 100 of the present invention is located on the exterior side 24 of the enclosure 20 and the pull tab 124 of the first zipper pull 120 is located on an interior side 22 of the enclosure 20. See FIG. 6. When a second zipper pull 130 is used, it is positioned in the same way relative to the security barrier 140 as the first zipper pull 120. In this embodiment, a person located inside 22 the enclosure 20 can use the secure zipper 100 to close the door 28 of the enclosure 20 and position the pull tab 124 of the first zipper pull 120 (and the pull tab 134 of the second zipper pull 130, if used) behind the security barrier 140. This prevents access to the pull tab 124 of the first zipper pull 120 (and the pull tab 134 of the second zipper pull 130, if used) to persons located outside 24 of the enclosure 20. This configuration is useful when the goal is to keep persons out of the enclosure 20, such as when the enclosure 20 is a tent 40.

What has been described and illustrated herein are preferred embodiments of the secure zipper of the present invention along with some it its variations. The terms, descriptions and figures used herein are set forth by way of illustration only and are not meant as limitations. Those skilled in the art will recognize that many variations are possible within the spirit and scope of the invention in which all terms are meant in their broadest, reasonable sense unless otherwise indicated. Other embodiments not specifically set forth herein are also contemplated.

I claim:

1. A secure zipper to be used in conjunction with an enclosure having an entryway, in which the secure zipper serves to close a door to the entryway of the enclosure, said secure zipper comprising a first set of zipper teeth, said first set of zipper teeth being located along an edge of the enclosure defining the entryway;

a second set of zipper teeth, said second set of zipper teeth being located along an edge of the door proximate to the edge of the enclosure defining the entryway;

a first zipper pull, said first zipper pull having a zipper teeth engagement component and a pull tab attached thereto, wherein the zipper teeth engagement component of the first zipper pull engages with the first set of zipper teeth and the second set of zipper teeth, such that movement of the zipper teeth engagement component of the first zipper pull in a first direction causes the first set of zipper teeth to engage with the second set of zipper teeth in an interlocking manner, and movement of the zipper teeth engagement component of the first zipper pull in a second direction opposite the first direction causes the first set of zipper teeth to disengage from the second set of zipper teeth; and a security barrier, said security barrier having a width and a length and being fixedly attached to the edge of the enclosure and the edge of the door proximate to a terminal end of the secure zipper, wherein the length of the security barrier is greater than a length of the pull tab of the first zipper pull;

wherein the security barrier is located on an interior side of the enclosure and the pull tab of the first zipper pull is located on an exterior side of the enclosure;

whereby, when the first zipper pull is positioned at said terminal end of the secure zipper, the entirety of the first zipper pull and the pull tab of the first zipper pull is located behind the security barrier, and a person located exterior to the enclosure can use the secure zipper to close the door of the enclosure and position the pull tab of the first zipper pull behind the security barrier, preventing access to the pull tab of the first zipper pull to persons located within the enclosure.

2. The secure zipper of claim 1 wherein the enclosure is a bed enclosure.

3. The secure zipper of claim 1 wherein the security barrier is substantially rectangular.

4. The secure zipper of claim 1 wherein the security barrier is made of canvas.

5. A secure zipper to be used in conjunction with an enclosure having an entryway, in which the secure zipper serves to close a door to the entryway of the enclosure, said secure zipper comprising a first set of zipper teeth, said first set of zipper teeth being located along an edge of the enclosure defining the entryway;

a second set of zipper teeth, said second set of zipper teeth being located along an edge of the door proximate to the edge of the enclosure defining the entryway;

a first zipper pull, said first zipper pull having a zipper teeth engagement component and a pull tab attached thereto, wherein the zipper teeth engagement component of the first zipper pull engages with the first set of zipper teeth and the second set of zipper teeth, such that movement of the zipper teeth engagement component of the first zipper pull in a first direction causes the first set of zipper teeth to engage with the second set of zipper teeth in an interlocking manner, and movement of the zipper teeth engagement component of the first zipper pull in a second direction opposite the first direction causes the first set of zipper teeth to disengage from the second set of zipper teeth; and a security barrier, said security barrier having a width and a length and being fixedly attached to the edge of the enclosure and the edge of the door proximate to a terminal end of the secure zipper, wherein the length of the security barrier is greater than a length of the pull tab of the first zipper pull;

wherein the security barrier is located on an exterior side of the enclosure and the pull tab of the first zipper pull is located on an interior side of the enclosure;

whereby, when the first zipper pull is positioned at said terminal end of the secure zipper, the entirety of the first zipper pull and the pull tab of the first zipper pull is located behind the security barrier, and an occupant located within the enclosure can use the secure zipper to close the door of the enclosure and position the pull tab of the first zipper pull behind the security barrier, preventing access to the pull tab of the first zipper pull to persons located exterior of the enclosure.

6. The secure zipper of claim 2 wherein the enclosure is a tent.

7. The secure zipper of claim 5 wherein the security barrier is substantially rectangular.

8. The secure zipper of claim 5 wherein the security barrier is made of canvas.

9. A secure zipper to be used in conjunction with an enclosure having an entryway, in which the secure zipper serves to close a door to the entryway to the enclosure, said secure zipper comprising a first set of zipper teeth, said first set of zipper teeth being located along an edge of the enclosure defining the entryway;

a second set of zipper teeth, said second set of zipper teeth being located along an edge of the door proximate to the edge of the enclosure defining the entryway;

a first zipper pull, said first zipper pull having a zipper teeth engagement component and a pull tab attached thereto, wherein the zipper teeth engagement component of the first zipper pull engages with the first set of zipper teeth and the second set of zipper teeth, such that movement of the zipper teeth engagement component of the first zipper pull in a first direction causes the first set of zipper teeth to engage with the second set of zipper teeth in an interlocking manner, and movement of the zipper teeth engagement component of the first zipper pull in a second direction opposite the first direction causes the first set of zipper teeth to disengage from the second set of zipper teeth;

a second zipper pull, said second zipper pull having a zipper teeth engagement component and a pull tab attached thereto, wherein the zipper teeth engagement component of the second zipper pull engages with the first set of zipper teeth and the second set of zipper teeth, such that movement of the zipper teeth engagement component of the second zipper pull in the second direction causes the first set of zipper teeth to engage with the second set of zipper teeth in an interlocking manner, and movement of the zipper teeth engagement component of the second zipper pull in the first direction opposite the second direction causes the first set of zipper teeth to disengage from the second set of zipper teeth; and a security barrier, said security barrier having a width and a length and being fixedly attached to the edge of the enclosure and the edge of the door proximate to a terminal end of the secure zipper, wherein the length of the security barrier is greater than a combination of a length of the pull tab of the first zipper pull and a length of the pull tab of the second zipper pull;

wherein the security barrier is located on an interior side of the enclosure, the pull tab of the first zipper pull is located on an exterior side of the enclosure, and the pull tab of the second zipper pull is located on the exterior side of the enclosure;

whereby, when the first zipper pull is positioned at said terminal end of the secure zipper and the second zipper pull is positioned at said terminal end of the secure zipper adjacent to the first zipper pull the entirety of the first zipper pull and the pull tab of the first zipper pull is located behind the security barrier, and the entirety of the second zipper pull and the pull tab of the second zipper pull is located behind the security barrier, and a person located exterior to the enclosure can use the secure zipper to close the door of the enclosure and position the pull tab of the first zipper pull behind the security barrier and the pull tab of the second zipper pull behind the security barrier, preventing access to the pull tab of the first zipper pull and the pull tab of the second zipper pull to persons located within the enclosure.

10. The secure zipper of claim 9 wherein the enclosure is a bed enclosure.

11. The secure zipper of claim 9 wherein the security barrier is substantially rectangular.

12. The secure zipper of claim 9 wherein the security barrier is made of canvas.

13. A secure zipper to be used in conjunction with an enclosure having an entryway, in which the secure zipper serves to close a door to the entryway to the enclosure, said secure zipper comprising a first set of zipper teeth, said first set of zipper teeth being located along an edge of the enclosure defining the entryway;

a second set of zipper teeth, said second set of zipper teeth being located along an edge of the door proximate to the edge of the enclosure defining the entryway;

a first zipper pull, said first zipper pull having a zipper teeth engagement component and a pull tab attached thereto, wherein the zipper teeth engagement component of the first zipper pull engages with the first set of zipper teeth and the second set of zipper teeth, such that movement of the zipper teeth engagement component of the first zipper pull in a first direction causes the first set of zipper teeth to engage with the second set of zipper teeth in an interlocking manner, and movement of the zipper teeth engagement component of the first zipper pull in a second direction opposite the first direction causes the first set of zipper teeth to disengage from the second set of zipper teeth;

a second zipper pull, said second zipper pull having a zipper teeth engagement component and a pull tab attached thereto, wherein the zipper teeth engagement component of the second zipper pull engages with the first set of zipper teeth and the second set of zipper teeth, such that movement of the zipper teeth engagement component of the second zipper pull in the second direction causes the first set of zipper teeth to engage with the second set of zipper teeth in an interlocking manner, and movement of the zipper teeth engagement component of the second zipper pull in the first direction opposite the second direction causes the first set of zipper teeth to disengage from the second set of zipper teeth; and a security barrier, said security barrier having a width and a length and being fixedly attached to the edge of the enclosure and the edge of the door proximate to a terminal end of the secure zipper, wherein the length of the security barrier is greater than a combination of a length of the pull tab of the first zipper pull and a length of the pull tab of the second zipper pull;

wherein the security barrier is located on an exterior side of the enclosure, the pull tab of the first zipper pull is located on an interior side of the enclosure, and the pull tab of the second zipper pull is located on the interior side of the enclosure;

whereby, when the first zipper pull is positioned at said terminal end of the secure zipper and the second zipper pull is positioned at said terminal end of the secure zipper adjacent to the first zipper pull the entirety of the first zipper pull and the pull tab of the first zipper pull is located behind the security barrier, and the entirety of the second zipper pull and the pull tab of the second zipper pull is located behind the security barrier, and an occupant located within the enclosure can use the secure zipper to close the door of the enclosure and position the pull tab of the first zipper pull behind the security barrier and the pull tab of the second zipper pull behind the security barrier, preventing access to the pull tab of the first zipper pull and the pull tab of the second zipper pull to persons located exterior of the enclosure.

14. The secure zipper of claim 13 wherein the enclosure is a tent.

15. The secure zipper of claim 13 wherein the security barrier is substantially rectangular.

16. The secure zipper of claim 13 wherein the security barrier is made of canvas.

* * * * *